US006964519B2

(12) United States Patent
ErkenBrack

(10) Patent No.: US 6,964,519 B2
(45) Date of Patent: Nov. 15, 2005

(54) ATMOSPHERIC AND/OR DIFFERENTIAL PRESSURE CLOSURE FOR AN EVACUABLE STORAGE CONTAINER

(76) Inventor: Kenneth Beresford ErkenBrack, 3004 Looking Glass Ct., Virginia Beach, VA (US) 23456

( * ) Notice: Subject to any disclaimer, the term of this patent is extended or adjusted under 35 U.S.C. 154(b) by 0 days.

(21) Appl. No.: 10/893,004

(22) Filed: Jul. 16, 2004

(65) Prior Publication Data

US 2005/0025396 A1 Feb. 3, 2005

Related U.S. Application Data

(60) Provisional application No. 60/490,985, filed on Jul. 30, 2003, provisional application No. 60/494,853, filed on Aug. 14, 2003, provisional application No. 60/527,536, filed on Dec. 8, 2003.

(51) Int. Cl.[7] ..... B65D 33/16
(52) U.S. Cl. ..... 383/64; 383/103
(58) Field of Search ..... 383/63–34; 24/584.1, 24/585.1, 585.12, 399

(56) References Cited

U.S. PATENT DOCUMENTS 2,613,421 A * 10/1952 Madsen ..... 24/399
2,777,181 A * 1/1957 Morner ..... 24/399
3,070,864 A * 1/1963 Pfeffer ..... 24/399
3,259,951 A * 7/1966 Zimmerman ..... 24/399
3,633,642 A * 1/1972 Siegel ..... 383/64
3,918,131 A * 11/1975 Ausnit ..... 24/586.1
4,199,845 A * 4/1980 Ausnit ..... 24/399
4,268,938 A * 5/1981 Walchli ..... 53/334
5,142,970 A 9/1992 ErkenBrack
6,059,457 A 5/2000 Sprehe et al.
6,581,253 B2 6/2003 ErkenBrack

* cited by examiner

*Primary Examiner*—Jes F. Pascua
(74) *Attorney, Agent, or Firm*—Bradley D. Goldizen; Goldizen & Associates

(57) ABSTRACT

An evacuable bag or container for items which benefit from being stored in a vacuum environment by reason that the bag or container is impermeable to air or liquid, with a first opening for entrance or closure purposes, which first opening has a zipper sealing closure adjacent thereto and integral with said bag or container for closing and opening purposes, the sealing integrity of which is aided by atmospheric and/or differential pressures, and a second opening, with an exit-only valve therein, for connection purposes to an external vacuum source, by which means said bag or container can be evacuated of air or liquid. Thus, this invention provides the constituent key to a relatively inexpensive appliance system for home vacuum packaging of perishables and/or items requiring compression packaging due to limited storage space.

2 Claims, 4 Drawing Sheets

FIG. 13
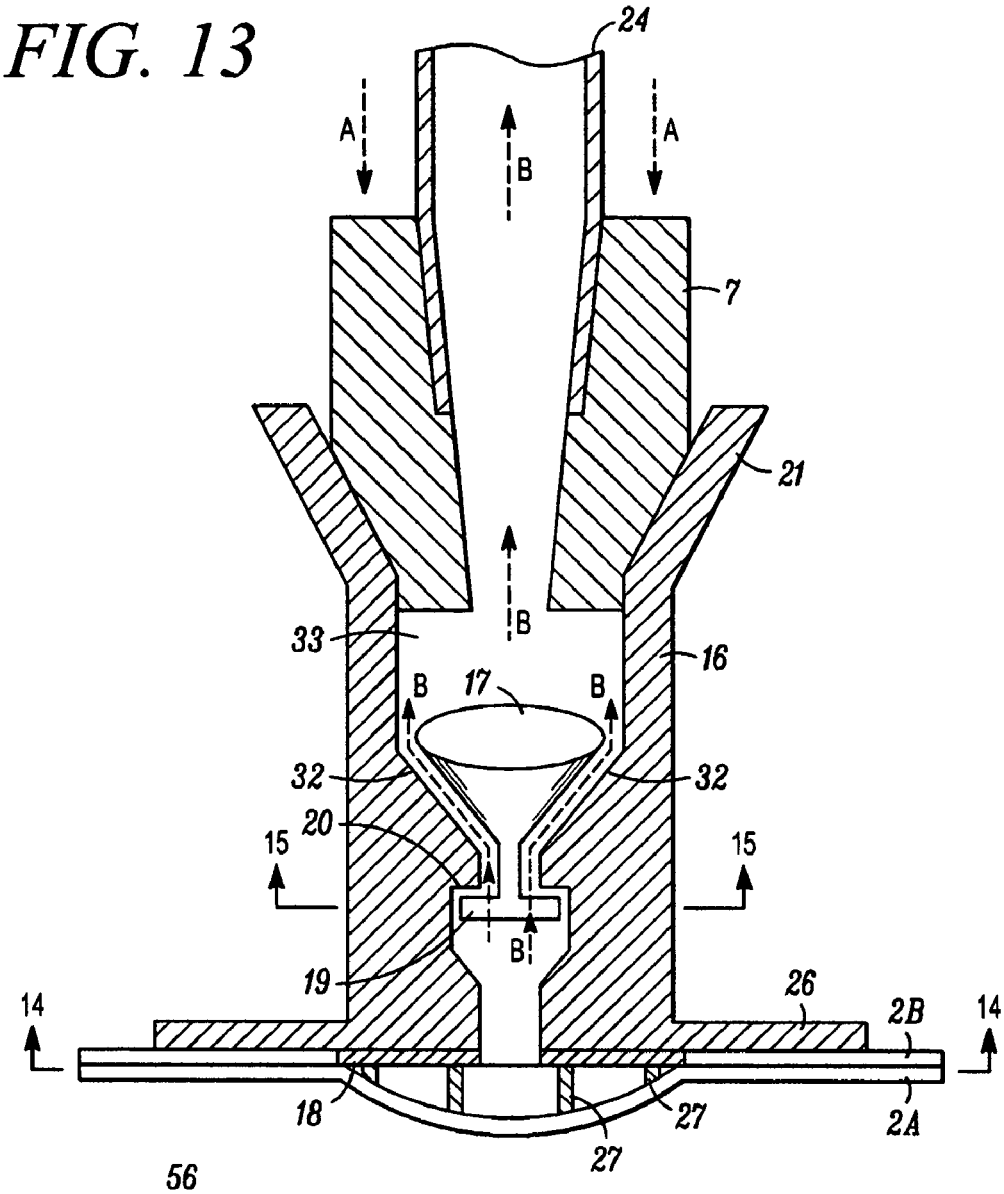
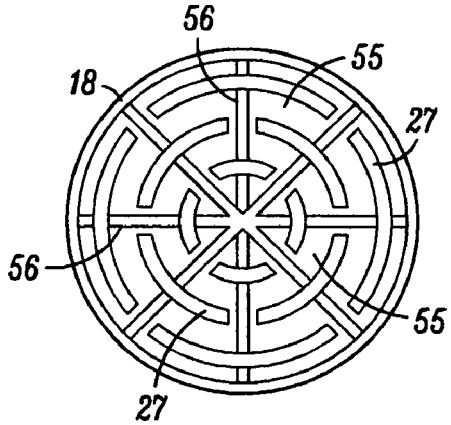
FIG. 14
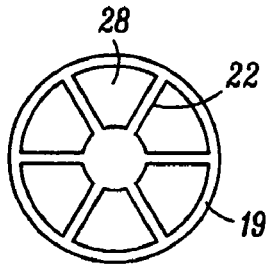
FIG. 15

ATMOSPHERIC AND/OR DIFFERENTIAL PRESSURE CLOSURE FOR AN EVACUABLE STORAGE CONTAINER

The present invention claims priority from U.S. Provisional Patent Applications Ser. No. 60/490,985 filed Jul. 30, 2003, Ser. No. 60/494,853 filed Aug. 14, 2003 and Ser. No. 60/527,536 filed Dec. 8, 2003. The patent application includes materials submitted in Disclosure Documents Ser. No. 537319 filed Aug. 28, 2003, Ser. No. 538299 filed Sep. 12, 2003, Ser. No. 542617 filed Nov. 24, 2003, and Ser. No. 543825 filed Dec. 19, 2003.

The present application received no federal research and development funding.

FIELD OF THE INVENTION

Generally, the present invention relates to closures for storage containers such as plastic bags. More specifically, the invention relates to a flexible storage container and associated system for use in storing articles or goods in a vacuum sealed environment. The storage container may comprise nylon or other impermeable material.

The word "fluid" is referenced throughout the application and should be interpreted broadly to include both liquid, gases or mixtures thereof. A vacuum source for evacuating fluid(s) from the container of the instant invention may include an electric pump, manual pump, or other such source for supplying a vacuum to evacuate the storage container of fluid(s).

The present invention relates to an impermeable plastic bag or container including a zipper closure comprising two tracks for sealing an opening through which a material, to be stored within the interior of the bag, is passed. The opening is defined by two sidewalls which are comprised of a material impervious to gas or fluids. The zipper closure is also made of an impermeable material and is so designed to attach to edges of the opening, and employ existing atmospheric and/or differential pressure to enhance the sealing integrity between the two tracks. Thus, the present invention will provide an inexpensive means for home vacuum packaging of items which benefit, storage-wise, by being in a vacuum stored state, sans the need of heat sealing said closure.

BACKGROUND OF THE INVENTION

It is known that food articles may be readily preserved by vacuum storing them in a gasless environment. Likewise, it has been realized that compressible articles or materials may be subjected to a vacuum sealed environment to achieve space saving results. The inventor of the instant invention holds several patents relating to the vacuum packaging technologies. U.S. Pat. Nos. 6,581,253 and 5,142,970, incorporated herein by reference thereto, discloses fluid-tight containers and apparatuses for storing contents of a container in a vacuum sealed environment.

For years many inventors have pursued various techniques for evacuating gases from a container to provide a gasless storage environment. Some of these techniques include using a container that comprises a zipper seal consisting of two strips that are manually forced together along their lengths, such as is disclosed in U.S. Pat. No. 6,059,457. In this instance, a first strip includes a rib extending from a surface thereof. The second strip, opposite the first, comprises at least two ribs extending from a surface thereof. These two ribs are offset from the first such that the rib of the first strip may be forced between the offset ribs to seal an opening in the bag. Air or other gases may be evacuated from the bag via a second opening. The use of this type of seal may not adequately prevent leakage of gases back into the bag after a vacuum source is connected to the bag. The vacuum source creates a negative pressure which tends to pull downward on the seal created by the strips. Thus, the ribs are pulled apart which allows the seal to be broken thereby allowing gas to reenter the bag. While other differences are evident between the instant invention and those details disclosed in U.S. Pat. No. 6,059,457, the use of atmospheric or differential pressures to aid in sealing the closure is unique and new to prior art.

The present invention overcomes the deficiencies of the prior art in that both atmospheric pressure and negative pressure attributable to a vacuum source exert forces in a normal to the surfaces of a seal that seals an opening. Therefore, a more secure seal is realized that does not suffer from the inadequacies of the prior art by utilizing atmospheric and differential pressures to aid in the sealing of the opening.

SUMMARY OF THE INVENTION

The invention is an evacuable bag or container for items which benefit from being stored in a vacuum environment by reason that the bag or container is impermeable to air or liquid. The bag includes a first opening for accessing the interior of the bag to deposit or remove items. This opening includes a zipper sealing closure adjacent thereto and integral with the bag or container for closing and opening purposes. Flexible sealing strips are arranged to be aided by atmospheric and/or differential pressures, unlike prior art devices. The flexible sealing strips include tracks having complementary rails that react to seal the first opening in the bag more solidly when a differential pressure is applied thereto. The tracks may include material having differing degrees of hardness such that one of tracks may be more mailable than the other. A second opening, with an exit-only valve therein, for connection purposes to an external vacuum source, by which means said bag or container can be evacuated of air or liquid is also included in the bag or container. This coupler, comprising a unidirectional valve, is included in a sidewall of the bag for sealing the second opening.

The sealing technology offered herein is unique as well as robust, being analogous to the well known practice of placing a suction cup on a flat smooth surface, pressing it down to expel the air from under the cup, thus producing a vacuum thereunder, whereupon atmospheric pressure at 14.7 pounds per square inch (psi) now presses against this vacuum, holding the cup tightly to said surface. If all the air were expelled from under the cup, the pressure holding the cup to the surface would be equal to the ambient atmospheric pressure, normally at 14.7 pounds per square inch at seal levels which, while unlikely or unnecessary to achieve, does teach the degree of the force which may be captured or harnessed to aid the sealing integrity of the invention specified herein.

Further, on a larger scale, said sealing technology is employed as the means of handling, carry and transporting heavy commercial plate glass. The device is called a Power-Grip Vacuum Cup, being a 6 to 10 inch circular disc, which is held against the glass while the handler, holding the device, repeatedly works a plunger with his thumb, thus operating a manual vacuum pump within the handle and thus concaving the disc's base, at which point atmospheric pressure earnestly attaches, in a unrelenting manner, the device to the heavy glass. A 9 inch diameter Vacuum Cup is capable of holding a glass plate, without any motion, sliding or otherwise, even when the glass is in a vertical posture, by providing over 600 pounds of attachment pressure.

The following is another example of the degree of sealing assistance which may be realized by using this invention. In this example it is assumed that atmospheric pressure is 14.7 psi (pounds per square inch) and that a one way exhaust value coupler is an integral part of the bag for connecting to a vacuum source. After placing the contents in the bag and closing the first opening with the zipper closure, a vacuum is introduced in the bag via the coupler until the vacuum therein reaches 300 Torr (which is the vacuum level of one the devices presently being sold on the market). Three hundred Torr is equivalent to 18.109 inHg (inches of mercury) which also equates to negative of 8.896 psi, causing a differential pressure to exist between the 14.7 psi outside and the negative 8.896 psi inside. This results in a 60% vacuum environment within the bag which tightens the closure track 60% tighter than it was initially without the aid of the vacuum source. As the vacuum is increased further, the seal will tighten further, until the unlikely (theoretical) absolute vacuum of negative 14.7 psi inside (100% vacuum) is reached (29.92 inHg) which is equal to the ambient atmospheric pressure outside the bag, normally at 14.7 psi. Considering the power of atmospheric pressure and the degree of vacuum which can be achieved, the resulting force pressing on and holding the tracks together is quite prodigious as one may now appreciate.

The sealing technology offered herein is most effective, particularly on smooth profile surfaces, in that it firmly seats a pair of flexible sealing strips or mating tracks that comprise the zipper closure together once a vacuum is initiated or established. Prior to the introduction of a vacuum, this type of novel sealing is insured by the mechanical latching or locking of the profiles of the mating tracks by means of the longitudinal hooked shaped ridge snapping into its compatible, longitudinal, mating groove.

It is evident that in a pressure environment, pressure acts evenly, at right or normal angles, upon all surfaces with which it contacts. Thus, it follows that when a vacuum exists within a sealed bag or container, atmospheric pressure presses evenly on all outside surfaces, including its exposed closure seal. Accordingly, the reclosable zipper seal specified herein is so designed to accept that pressure as a sealing aid, by intentionally arranging its design to insure that all exterior surfaces, when acted upon by atmospheric or any differential pressure, will assist, directional force-wise, to further seat and tighten the interlocking closure tracks.

Thus, the present invention teaches an airtight zipper on a plastic bag which has a one way valve for vacuum evacuation of the fluid within. This novel design utilizes atmospheric or differential pressures to aid in the closure sealing. In all the embodiments of this invention, the design objectives are that: (1) the mating surfaces are relatively large, flush, and smooth; (2) in order to realize a complete and ultimate surface mating of the track profiles to prevent leakage, the material for one of the track profiles may be made more malleable or softer than the other, thus conforming to the surface shape of the opposite profile, effectively melting the two together; (3)the curvature and shape of the mating surfaces are such, that when the closing is slightly awry, but one protuberance of profile contacts its counterpart profile, then the closing profiles will adjust and continue to close and seat smoothly; (4) the positioning of the mechanical latching and locking means of the two profiles of the first two embodiments of the invention is deep within the mating profiles, thus disallowing leakage; (5) when a vacuum occurs within the bag or container, or when differential pressures exist on either side of the seal, the sealing integrity of the seal is increased proportionally to the degree of the pressure differences; (6) when a distal end of the tube from the vacuum source mates with the bag's coupler, its design allows for a quick connect/disconnect operation, without a mechanical connection, by use of atmospheric pressure to hold the distal end onto the coupler once a vacuum is initiated.

Upon achieving the desired vacuum within the bag, as evidenced by the bag's walls collapsing about its contents, a truncated conical plug (not shown) should be inserted into the coupler's cone shaped exit area to provide additional insurance that the vacuum therein is maintained, the seating of which is also being aided by atmospheric pressure.

To open a sealed bag (1) the track can be cut from the sidewall of the bag; (2) the slider can be forcibly reversed; or (3) the conical valve may be lifted slightly by a mechanical means (not shown), thus providing equalization of the existing differential pressures.

When incorporated into an impermeable nylon layered plastic bag, and intensifying the hermetic sealing of its closure tracks by the aid of atmospheric pressure forcing the tracks tightly together when a vacuum is introduced within the bag, this invention becomes the constituent key to providing an inexpensive home packaging appliance as well as an effective fluid-tight plastic bag for storing articles.

In addition to considering this invention as a new bag product principally for article and food storage and preservation, it should also find space and underwater applications. In the environment of outer space, an item can be placed in such a bag, zippered shut, and upon reentering the atmosphere, the closure will be tightened by atmospheric pressure since there is no need for creating the already established vacuum. Further, applying it to diver suits, gloves or boots, the zipper closure will obviously tighten with the increase of water pressure as the diver descends to lower depths due to differential pressures.

With the bag's closure, the tracks are released from the supporting T-rails of the slider and the latching or locking mechanism now is holding the tracks together. Following the introduction of a vacuum within the bag, the tracks (especially when made of various malleable plastics) adapt and melt together to achieve an even more complete facial closure by movement about pivotal points due to differential pressures.

The present invention includes a leak-proof bag with flexible mating strips of interdigitated profiles which are relatively large, flush, with smooth surfaces shaped to mesh exactly with each other when seated. This is contrary to existing prior art devices that include a male profile that must break through ridges of a female groove profile to leave a leakage gap. Thus, the prior art devices result in a relatively loose engagement between the mating strips.

In a pressure environment, pressure acts evenly upon all surfaces with which it contacts. Thus, when a vacuum exists within a contained or sealed bag, atmospheric pressure exerts a force evenly over all exterior surfaces of the bag, including its exposed closure seal. Accordingly, the seal of the present invention is designed to utilize this pressure as a sealing aid, by arranging the elements of the seal to ensure that exterior surfaces, when acted upon by atmospheric pressure, the seating and sealing of the interlocking closure tracks may be aided. Thus, when a vacuum is introduced within the bag, or when a differential pressure exists on either side of the seal, the sealing integrity of the seal is increased proportionally to the degree of pressure differences.

It is an object of the invention to provide a sealing mechanism that comprises interlocking profiles. The facial surfaces of these are smooth, flush, relatively large and shaped to ensure mating and seating of the profiles such that no clearance between the mating surfaces is present when closed.

It is another object of the invention to provide an interlocking of two profiles wherein a locking means is located within the depths of the two mating surfaces to prevent the locking means from detracting or adversely affecting the efficiency of profiles to provide a complete sealing result.

It is another object of the invention to provide a container that includes a sealing means comprising a pair of flexible mating strips which increase its sealing integrity when a differential pressure exists on either side of the seal. The sealing integrity increases proportionally to the degree of pressure differences.

It is a further object of the invention to provide a sealing mechanism comprising two flexible mating strips having a complementary curvature and shape such that when alignment of the closing surfaces of the mating strips is slightly awry, the closing surfaces will easily adjust to close and seat securely.

It is an additional object of the invention to provide a pair of flexible mating strips that comprise profiles having a shape and pliability such that when closed and experiencing any differential pressures, the sealing integrity increases without flattening the surfaces exposed to the pressures and preventing separation of the profiles and leaking of fluids therebetween.

It is a further object of the invention to provide an evacuable container for items which benefit from being stored in a fluid-less environment by reason that the container is impermeable to fluid. The container includes a first entrance that comprises a re-closable zipper, the sealing integrity of which is aided by atmospheric and/or differential pressures. A second opening includes an exit only valve connection for evacuating fluids from the bag via a vacuum source.

Additional objects and advantages of the invention will be set forth in part in the description which follows, and in part will be obvious from the description, or may be learned from practicing the invention. The objects and advantages of the invention will be obtained by means of instrumentalities in combinations particularly pointed out in the appended claims.

BRIEF DESCRIPTION OF THE DRAWINGS

FIG. 13 is a sectional view illustrating a coupler system for coupling a vacuum source to the bag. A conical-shaped valve for sealing an opening for evacuating fluids from the container is included within the coupler system.

FIG. 14 is a plan view of a base that includes a plurality of spacer vanes taken from line 14—14 of FIG. 13, which prevent air passage obstruction of the bag walls during fluid evacuation.

FIG. 15 is a plan view of the base of the conical valve taken from line 15—15 of FIG. 11 allowing air passage.

DETAILED DESCRIPTION OF THE INVENTION

Figure 1:
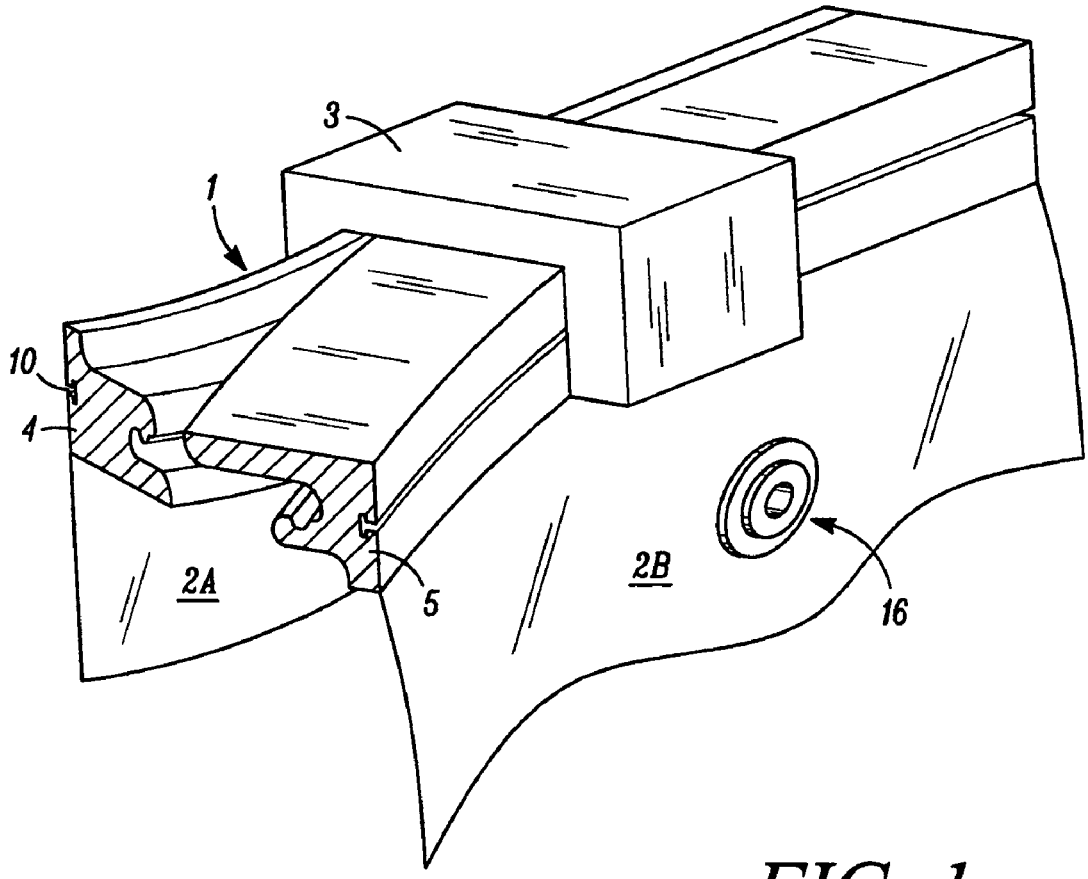
FIG. 1 is a perspective view of a pair of interlocking flexible sealing strips according the present invention. Each sealing strip attaches to respective edges of an opening in a flexible bag. A slider for melting and separating the strips moves along T-shaped tracks arranged on an exterior side of each strip. A connector for use in evacuating fluid from an interior of the bag is also shown.

FIG. 1 depicts a preferred embodiment of the invention that is a flexible bag 1 for storing articles therein. The bag 1 may comprise various types of plastics, including but not limited to polyethylene, vinyl or nylon. Flexible mating surfaces or tracks 4 and 5 are affixed to sidewalls 2A and 2B of the container through known techniques such adhesives, heat welding, ultrasonic welding means or the like. Flexible mating surfaces 4 and 5 may be extruded or molded to include a constant cross-sectional profile along each entire length. These surfaces may comprise any non-porous flexible material that exhibits a low coefficient of friction on its surface. The profiles of the tracks may be identical and inverted and sealed to create a reciprocal interdigitization between the tracks.

Slider 3 is of a known shape. The sliding action of slider 3 causes the flexible mating surfaces 4 and 5 to be opened or closed depending on the direction of travel of the slider 3. In FIG. 1, slider 3 is shown in a position where the flexible mating surfaces 4 and 5 are separated to the left of the slider, as more clearly shown in FIG. 2. The flexible mating surfaces 4 and 5 are closed and securely seated to the right of the slider 3, as shown in FIG. 3. Each flexible mating surface includes a T-shaped recess 10 for accepting a complementary rail 6, as shown in the drawings discussed hereinafter. A couple 16 is included in one of the sidewalls for coupling the bag to a vacuum source to evacuate fluid from an interior of the bag.

Figure 2:
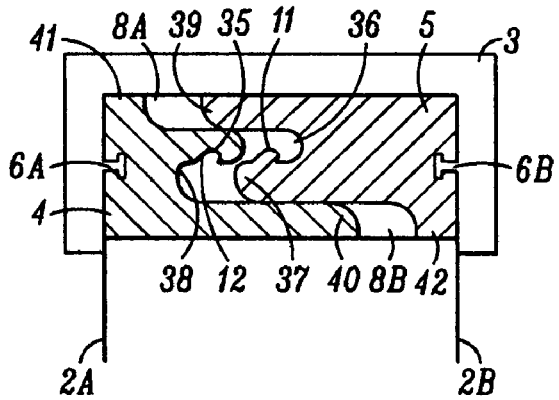
FIG. 2 is a transverse cross section view of a first embodiment of the sealing strips shown in FIG. 1 and taken to the immediate left of the slider. In this view the flexible sealing strips are aligned but are shown in an un-melted position. An end view of the slider and its associated T-rails are shown.
Figure 3:
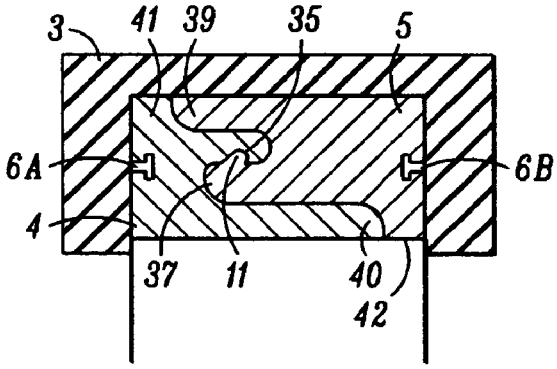
FIG. 3 is a transverse cross section view of the flexible sealing strips of FIG. 2 taken from the immediate right and showing the applicable portions of the flexible sealing strips in a mated or melted position.

FIG. 2 is a cross section of the bag's closing track and showing the initial open position of the profiles of tracks 4 and 5. Each track includes a T-shaped channel 10, shown in FIG. 1, for accommodating T-shaped rails 6A and 6B which are included on slider 3. It should be noted that the relationship of the channels and rails may be reversed such that the channels are included on interior sides of the slider; while rails may be include on the exterior edges of the tracks. In this figure, openings 8A and 8B are substantially similar in shape and size. A longitudinal ridge 11 is included on track 5. Longitudinal recess 12 is complementary in shape to longitudinal ridge 11 and is arranged on track 4 for receiving longitudinal ridge 11, as shown in FIG. 3. Track 4 includes an upper hook-shaped ridge 35 arranged next to a lower hook-shaped groove 38. Track 5 comprises an upper hook-shaped groove 36 for receiving upper hook-shaped ridge 35. Track 5 also includes a lower hook-shaped ridge 37 for mating with lower hook-shaped groove 38, as more clearly shown in FIG. 3. Track 4 also includes a lower extended edge 40 and upper truncated edge 41; while track 5 includes an upper extended edge 39 and lower truncated edge 42.

The combination of longitudinal ridge 11, longitudinal recess 12, hook-shaped ridges 35 and 37, and hook-shaped grooves 36 and 38 comprise a locking means for holding the tracks 4 and 5 together after closing. That is, the respective ridges melt into and are seated within their respective mating grooves, as shown in FIG. 3. The arrangement of the truncated edges 41 and 42 along with the extended edges 39 and 40 ensure that the locking means are located deep within the sealing surfaces to preclude leakage of fluid around the seal.

FIG. 3 corresponds to the embodiment shown in FIG. 2 and is to the right of the slider 3 as previously discussed. As shown, openings 8A and 8B collapse when the tracks 4 and 5 are melted together to create a seal. As previously mentioned, the ridges may comprise a more malleable material than that of the grooves to ensure that the ridges and grooves melt together to create a solid seal.

Figure 4:
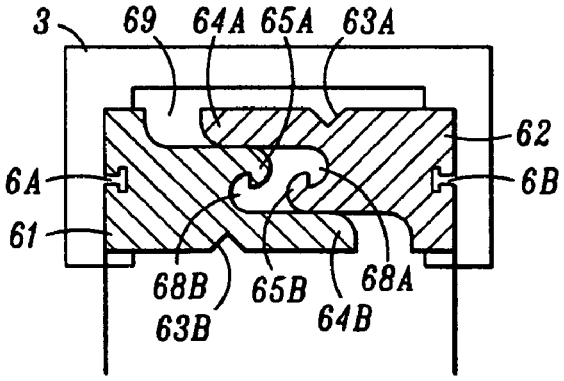
FIG. 4 is a transverse cross section of a second embodiment of the sealing strips shown in FIG. 1 and taken to the immediate left of the slider. In this view, the flexible sealing strips are aligned but are shown in an open position. It should be noted that both profiles are identical in size and shape and that one is inverted relative to the other. Further, longitudinal openings are provided along the exterior of the tracks to permit selected sections of the profiles to temporarily deform slightly, thus allowing a smoother interlocking engagement of said profiles.
Figure 5:
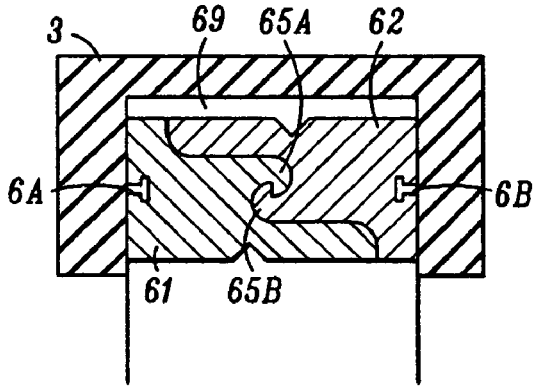
FIG. 5 is a transverse cross section view of the flexible sealing strips of FIG. 4 taken from the immediate right and showing said strips in a mated or closed position.

FIGS. 4 and 5 are similar to the previous FIGS. 2 and 3, respectively, except that tracks 61 and 62 are identical in size and shape, with track 62 being inverted in relation to track 61. Further, both tracks 61 and 62 are provided with flexible, longitudinal openings 63A and 63B, along with an expansion space 69 between the tracks and the roof of slider 3, thus allowing sections 64A and 64B to momentarily deform, thereby effectively aiding the engagement and latching of said tracks.

Upon closure of the tracks, longitudinal ridges 65A and 65B meet and seat in complementary longitudinal grooves 68A and 68B, respectively, as shown in FIG. 5.

Since tracks 61 and 62 are identical, booth tracks may be extruded from the same mold, which is advantageous for large scale production of the tracks.

FIGS. 6 through 9 show a third embodiment of the invention. Track 71 includes an upper and lower longitudinal ridge 30A and 30B for mating with complementary upper and lower longitudinal grooves 31A and 31B of track 72, as clearly shown in FIG. 9. In this embodiment, track 71 includes a vacuum channel 74 and 66 for applying a negative pressure therein to ensure that tracks 71 and 72 are securely seated when the vacuum source is connected to bag 1. An arcuate opening 73 is provided at the opening 66 of the vacuum channel 74. Upper and lower sealing surfaces 78A and 78B are arranged near and on opposite sides of arcuate opening 73.

Figure 6:
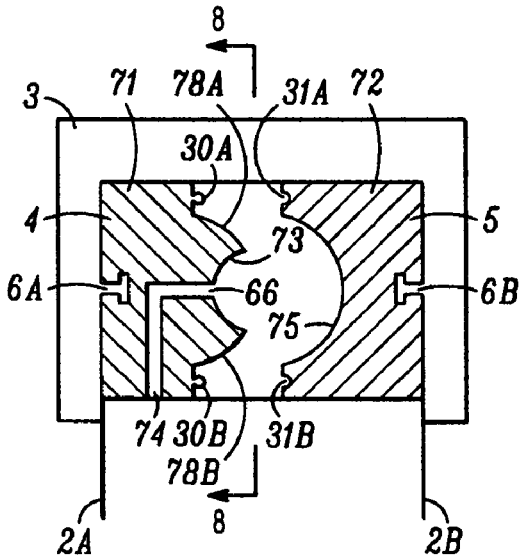
FIG. 6 is a transverse cross section view of a third embodiment of the sealing strips shown in FIG. 1 and taken to the immediate left of the slider. In this view the flexible sealing strips are aligned but are shown in an un-melted position. An end view of the slider and its associated T-rails are shown. A vacuum channel is provided for assisting in pulling the flexible sealing strips together to assure a secure seal.
Figure 7:
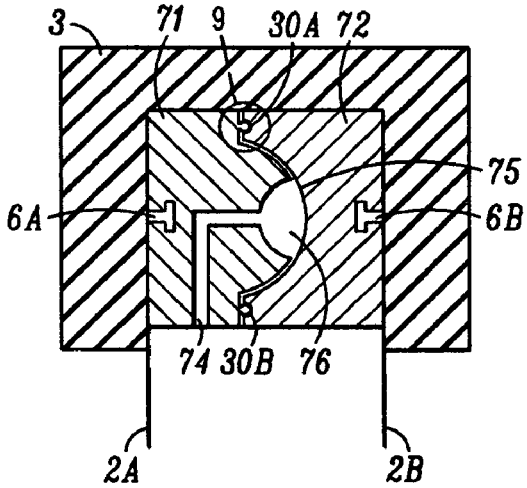
FIG. 7 is a transverse cross section view of the flexible sealing strips of FIG. 6 taken from the immediate right and showing the applicable portions of the flexible sealing strips in a mated or melted position. A vacuum opening is arranged at an end of the vacuum channel for exerting a differential pressure from one flexible sealing strip to the other. Longitudinal ridges and complementary recesses are provided near the upper and lower edge of each sealing strip.
Figure 8:
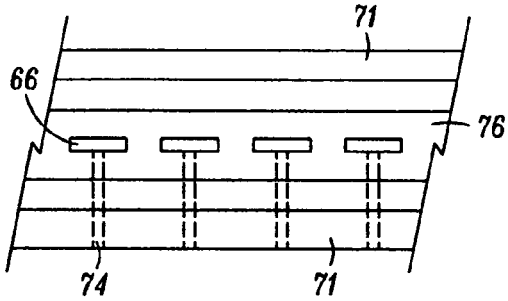
FIG. 8 is a partial elevation view of an interior of a flexible sealing strip, at intersectional line 8 in FIG. 6 showing the arrangement of vacuum channel openings 66.
Figure 9:
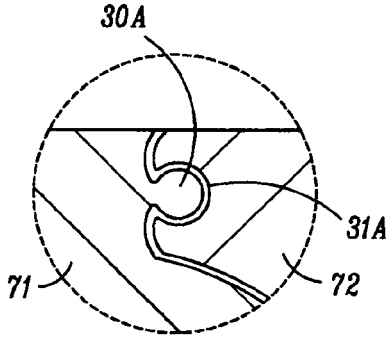
FIG. 9 is an enlarged view of the upper longitudinal ridge shown in FIGS. 6 and 7.

FIG. 7 shows the embodiment of FIG. 6 in a closed position. When a vacuum is introduced into bag 1, a negative pressure is exerted through vacuum channel 74 into arcuate vacuum chamber 76 causing arcuate sidewall 75 to be pulled towards and seat against upper and lower sealing surfaces 78A and 78B to assure a tight seal as shown. Vacuum openings 66 may be strategically spaced apart at regular intervals along track 71 as depicted in FIG. 8.

Figure 10:
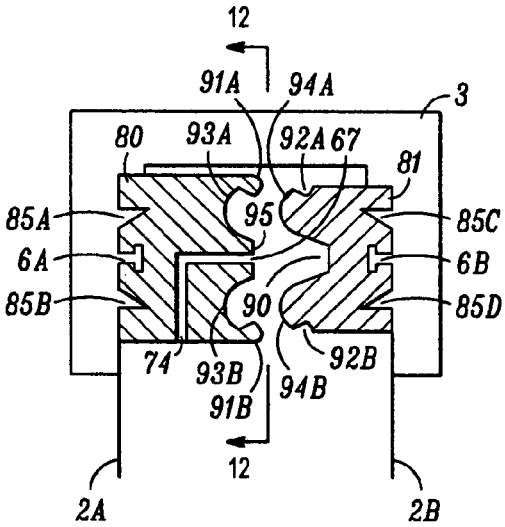
FIG. 10 is a transverse cross section view of a fourth embodiment of the sealing strips shown in FIG. 1 and taken to the immediate left of the slider. A hook-shaped rail is included near the top and bottom of one of the sealing strips; while a complementary recess is included at the top and bottom of the second sealing strip. In this view the flexible sealing strips are aligned but are shown in an un-melted position. An end view of the slider and its associated T-rails are shown.
Figure 11:
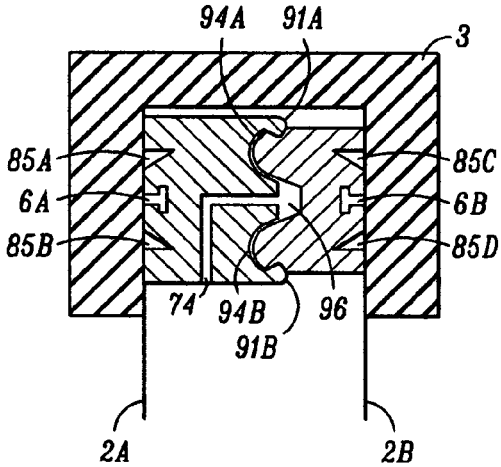
FIG. 11 is a transverse cross section view of the flexible sealing strips of FIG. 10 taken from the immediate right and showing the applicable portions of the flexible sealing strips in a mated or melted position.
Figure 12:
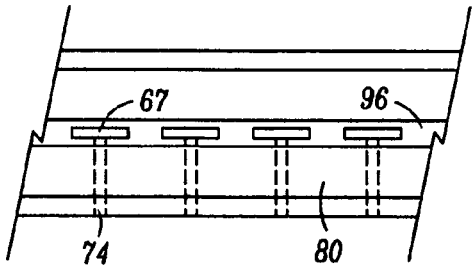
FIG. 12 is an elevation view of an interior of the track, at intersectional line 12 of FIG. 10 showing the arrangement of vacuum channel openings 67.

FIGS. 10 through 12 show a fourth embodiment of the sealing means for the present invention. Track 80 includes a hook-shaped longitudinal ridge 91A positioned above a curvilinear groove 93A. A hook-shaped longitudinal ridge 91B is arranged near a bottom of the track 80 below a second curvilinear groove 93B. Curvilinear grooves 93A and 93B define and end at surface area 95 of vacuum channel 74.

Track 81 comprises complementary grooves 92A and 92B arranged on an upper and lower surface of the track 81 as shown. These grooves 92A and 92B accept and lock with hook-shaped longitudinal ridges 91A and 91B thus allowing 94A and 94B to mate and melt with 93A and 93B following the initiation of a vacuum within FIG. 1. The point of contact between the ridges and grooves are arcuate to provide a larger contact area.

Each track 80 and 81 includes collapsible flex openings 85 near the top and bottom exterior surfaces for allowing the tracks to deform when a vacuum connected to the bag 1. When sealed, as shown in FIG. 11, a vacuum chamber 96 is created. Negative pressure exerted through vacuum channel 74, pulls recess 90 towards extended end 95 to assure a secure seal. Vacuum channels 74 and openings 67 may be arranged at regular intervals along track 80, as shown in FIG. 12.

FIG. 13 is an illustrated sectional view of coupler 16 showing base 26 affixed to a sidewall 2B. Coupler 16 includes a quick connect/disconnect head end 7 for accepting an end of tube 24 coupled to a vacuum source (not shown). A circular flange 21 is included at an end of coupler 16 for receiving head end 7. For use, the head end 7 is inserted into flange 21 as depicted by arrow A. When a vacuum is applied, the head end 7 is securely seated within circular flange 21 and fluid, represented by arrow B, is evacuated from the interior of the bag 1. As can be readily appreciated, the force of evacuating fluid caused unidirectional valve 17 to be biased open allowing fluid to be evacuated from the interior of the bag. Anchor 19 seats against lip 20 to maintain valve 17 within chamber 33 while a vacuum is applied. After the vacuum source is removed, the negative internal pressure of the bag and atmospheric pressure causes the valve 17 to seat and close against conical walls 32.

FIG. 14 depicts a base 18 taken from line 14-14 of FIG. 13. Circular sectional fin-like spacer projections or vanes 27 extend downward from the base 18 into bag 1. The projections 27 prevent air passages 55 from becoming obstructed during the fluid evacuation process. Wires 56 attached to base 18 support the fin-like projections 27 such that fluid may pass through passages 55.

FIG. 15 is a plan view of anchor 19, showing spokes 22 and openings 28 through which fluid passes during the vacuum sealing process. Arrows B, shown in FIG. 13, depict fluid passing through these openings. It may be desirable to include a plug or cap for placement in or over the flange 21 to insure that no leakage of the vacuum pressure within the bag occurs. Moreover, a vertical liquid storage trap may be inserted in series with the vacuum tubing to catch any excess liquids. While this valve describes a preferred method of practicing the invention, it should be readily understood that other types of valves such as leaf, flap, or ball valves may be utilized to practice the invention.

It is to be understood that the invention is not limited to the exact construction illustrated and described above, but that various changes and modifications may be made without departing from the spirit and the scope of the invention as defined in the following claims.

I claim:

1. A combination zipper closure and flexible container, said zipper closure utilizing atmospheric and differential pressures for sealing an opening in a flexible container that stores articles, said zipper closure comprising:

a first flexible mating strip attached to an edge of an opening and comprising a longitudinal hook-shaped ridge arranged along an interior edge thereof and having a T-shaped recess on an exterior edge thereof, said longitudinal hook-shaped ridge having an arcuate surface formed on one side of a longitudinal complementary hook-shaped groove that includes an arcuate surface, an extended section located on an opposite side of the complementary hook-shaped groove and having a longitudinal opening formed therein that allows the extended section to temporarily deform during opening and closing of the opening in the flexible container;

a second flexible mating strip attached to an opposite edge of the opening and including a longitudinal hook-shaped ridge arranged along an interior edge thereof and having a T-shaped recess on an exterior edge thereof, said longitudinal hook-shaped ridge having an arcuate surface formed on one side of a longitudinal complementary shaped hook-shaped groove that includes an arcuate surface, an extended section located on an opposite side of the complementary hook-shaped groove from said longitudinal hook-shaped ridge and having a longitudinal opening formed therein that allows the extended section to temporarily deform during opening and closing of the opening in the flexible container; and, a slider comprising T-shaped appendages that engages the T-shaped recesses on each flexible mating strip to force the strips together to close the opening or separate the tracks to aid in unfastening the opening, wherein said mating strips are arranged such that when sealed the longitudinal hook-shaped ridge of the first flexible mating strip mates with the arcuate surface comprising the recess of the second flexible mating strip such that when air is evacuated from the container, both atmospheric pressure external to the flexible container and negative pressure attributable to a vacuum source exert forces normal to the surfaces of the seal that seals the opening.

2. The zipper closure of claim 1 further including a vacuum source connector integral to said flexible container, said connector comprising:

a circular flange for receiving an end of a tube connected to a vacuum source;

a unidirectional valve arranged within said connector such that the valve is biased in a direction when a vacuum is applied to said circular flange, said valve including at least one opening through which fluid from an interior of a bag passes and an anchor for restricting said valve in an open position when a vacuum is applied to the circular flange, said valve further including a base.

* * * * *